US005112250A

United States Patent [19]

Wang

[11] Patent Number: 5,112,250

[45] Date of Patent: May 12, 1992

[54] T-TYPE COAXIAL CABLE CONNECTOR

[76] Inventor: Tsan-Chi Wang, 1F, No. 13, Lane 312, Chung Cheng Rd., Hsin Tien City, Taiwan

[21] Appl. No.: 708,578

[22] Filed: May 31, 1991

[51] Int. Cl.[5] ..... H01R 13/36

[52] U.S. Cl. ..... 439/582

[58] Field of Search ..... 439/578-585

[56] References Cited

U.S. PATENT DOCUMENTS

| | | | |
|---|---|---|---|
| 2,805,399 | 9/1957 | Leeper | 439/582 |
| 4,066,324 | 1/1978 | Stephens | 439/582 |
| 4,691,976 | 9/1987 | Cowen | 439/582 |

*Primary Examiner*—Joseph H. McGlynn

*Attorney, Agent, or Firm*—Varndell Legal Group

[57] ABSTRACT

A T-type coaxial cable adapter comprising an upper cover, a bottom cover, a BNC casing and a terminal, wherein said upper and bottom cover are connected together by screws, defining therein a coaxial cable mounting hole and a BNC casing mounting hole at right angles to each other; said terminal is comprised of a metal core covered with an outer insulator and firmly fastened in said BNC casing. Cutter means is fastened in the coaxial cable mounting hole to connect the braid shield of the coaxial cable that is fastened therein to an BNC connector which is connected to the BNC casing while the arrow-headed front end of the metal core of the terminal is inserted through the jacket of the coaxial cable to electrically connect the conductor thereof.

4 Claims, 5 Drawing Sheets

T-TYPE COAXIAL CABLE CONNECTOR

BACKGROUND OF THE INVENTION

The present invention relates to coaxial cable connectors and relates more particularly to a T-type coaxial cable adapter for connecting a branch coaxial cable from a computer terminal or peripheral equipment to the main coaxial cable in a computer network system.

In a computer system or computer network system, several terminals and other peripheral equipment may be simultaneously connected to a central processing unit for on-line operation. For signal transmission from a central processing unit to several terminals and other peripheral equipment through coaxial cables, a parallel-series signal converter is required to attach to the parallel signal output end and a series-parallel signal converter is required to attach to the parallel signal input end of each computer terminal or peripheral equipment. Therefore, a T-type coaxial cable connector is commonly used for connecting the main coaxial cable from a central processing unit to the branch coaxial cable to a computer terminal or peripheral equipment. The main disadvantage of the known structure of T-type coaxial cable connector is that the parallel signal from a computer system may be interfered easily by outside noises to affect signal transmission quality. Further, this T-type coaxial cable connector is generally incorporated in a series-parallel signal converter and therefore, it is not suitable for connecting a computer terminal to a main processing unit at far distance. If to connect a branch coaxial cable from a computer terminal or peripheral equipment to the main coaxial cable from a central processing unit by a conventional T-type coaxial cable connector, the main coaxial cable must be cut off and then attached with two BNC connectors so that a T-type coaxial cable connector can be attached to the main coaxial cable. This procedure is complicated to achieve and increase installation cost. Further, cutting off the main coaxial cable from a central processing unit may cause signal transmission loss.

SUMMARY OF THE INVENTION

The present invention has been accomplished to eliminate the aforesaid problems. It is therefore an object of the present invention to provide a T-type coaxial cable adapter which is practical in use to connect a branch coaxial cable to a main coaxial cable in a computer system or a computer network system.

It is another object of the present invention to provide a T-type coaxial cable adapter which can be directly conveniently mounted on a main coaxial cable in a computer or computer network system to connect a branch coaxial cable thereto.

It is still another object of the present invention to provide a T-type coaxial cable adapter which can minimize transmission loss when it is in use to connect a branch coaxial cable to a main coaxial cable in a computer system or computer network system.

DETAILED DESCRIPTION OF THE PREFERRED EMBODIMENT

Figure 1:
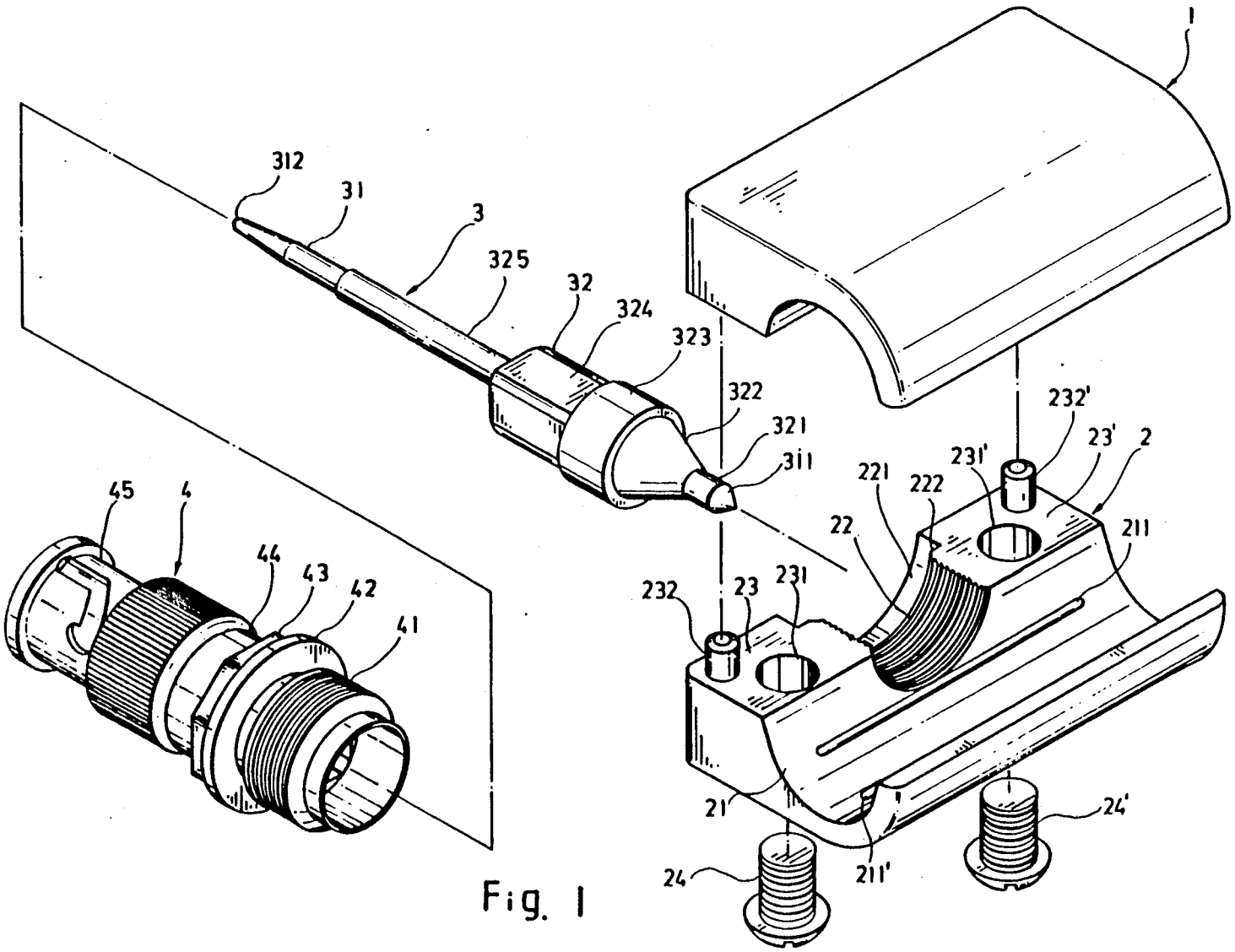
FIG. 1 is a dismantled perspective view of the preferred embodiment of the T-type coaxial cable adapter of the present invention.
Figure 2:
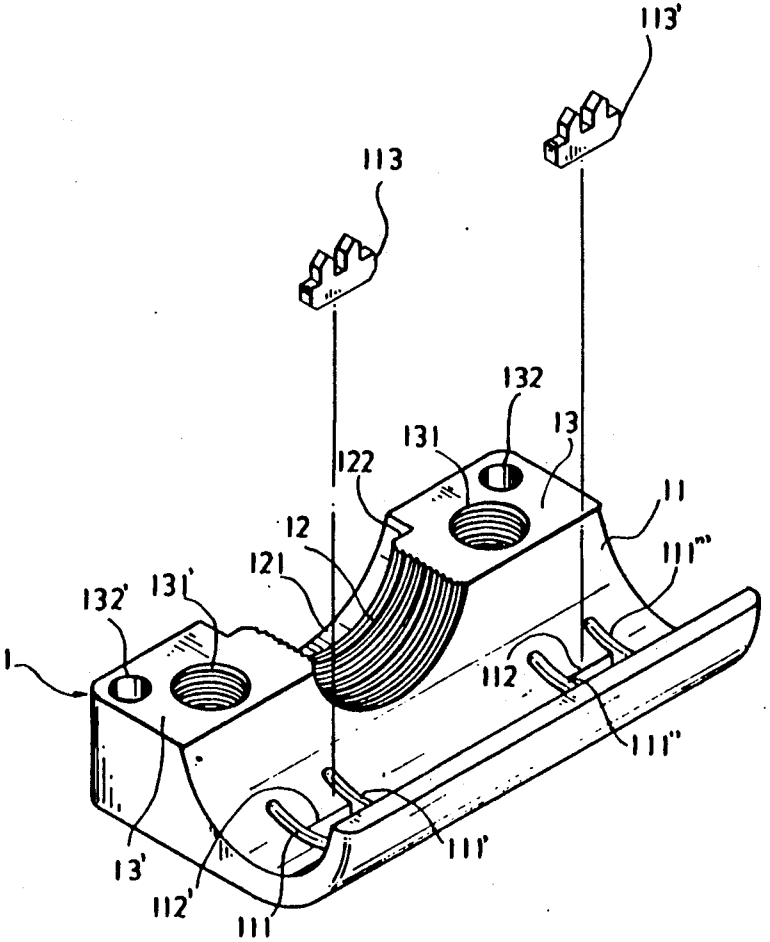
FIG. 2 is a perspective view of the upper cover.

Referring to FIGS. 1 and 2, a T-type coaxial cable adapter in accordance with the present invention is generally comprised of an upper cover 1, a bottom cover 2, a terminal 3 and a BNC casing 4.

The upper and bottom covers 1 and 2 are made of metal material in an elongated shape matched with each other, having each an elongated, semi-circular groove 11 or 21 disposed in longitudinal direction, a semi-circular bolt hole 12 or 22 disposed in transverse direction and connected to said elongated, semi-circular groove 11 or 21 at the middle, a semi-circular recess 121 or 221 on said semi-circular bolt hole 12 or 22 at one end spaced from said elongated, semi-circular groove 11 or 21 and in diameter larger than said semi-circular bolt hole 12 or 22 defining therebetween a stop edge 122 or 222, two raised top edges 13 and 13' or 23 and 23' at two opposite sides relative to said semi-circular bolt hole 12 or 22, wherein the two raised top edge 13 and 13' on the upper cover 1 have each a bolt hole 131 or 131' and a round hole 132 or 132'; the two raised top edge 23 and 23' on the bottom cover 2 have each a through-hole 231 or 231' and a circular stub rod 232 or 232'; the elongated semi-circular groove 11 on the upper cover 1 has two pairs of parallel ribs 111, 111', 111'' and 111''' disposed at two opposite ends in transverse direction (same as the bolt hole 12), two square holes 112 and 112' respectively disposed between each pair of parallel ribs 111 and 111' or 111'' and 111''', and two cutters 113 and 113' respectively fastened in said two square holes 112 and 112'; the elongated semi-circular groove 21 on the bottom cover 2 has three parallel ribs 211, 211' and 211'' disposed in longitudinal direction. The two circular stub rods 232 and 232' are made in outer diameter slightly smaller than the inner diameter of the round holes 132 and 132' and in height slightly shorter than the depth of the round holes 132 and 132' and therefore, they can be respectively inserted in the round holes 132 and 132' when the upper cover 1 is attached to the bottom cover 2 during assembly.

The terminal 3 is fastened in the BNC casing 4, comprising an elongated metal core 31 covered with an outer insulator 32. The elongated metal core 31 has an arrow-headed portion 311 at one end and a plug pin portion 312 at an opposite end. The outer insulator 32 covers over the elongated metal core 31 between the arrow-headed portion 311 and the plug pin portion 312, including five unitary portions respectively made in different shape and extending from one another in proper order. The five unitary portions of the outer insulator 32 is, from the front adjacent to the arrow-headed portion 311 to the back adjacent to the plug pin portion 312, the stub rod portion 321, the cone portion 322, the collar portion 323, the quadratic prism portion 324 and the elongated cylinder portion 325, wherein the stub rod portion 321 has an outer diameter equal to the major outer diameter of the arrow-headed portion 311.

The BNC casing 4 is a hollow metal shell having made around the outer wall surface thereof in proper order an outer thread 41, a projecting ring 42, a polygonal projection 43 and a flange 44 and, having fastened therein a BNC connector 45 at one end opposite to said outer thread 41. The inner wall of the BNC casing 4 between the outer thread 41, the projecting ring 42 and the polygonal projection 43 is made in shape fitting the collar portion 323 and the quadratic prism portion 324 of the outer insulator 32 of the terminal 3. Therefore, the terminal 3 can be firmly fastened in the BNC casing 4 with the cone portion 322, the stub rod portion 321 and the arrow-headed portion 311 projecting out of the front end (the outer thread 41) of the BNC casing 4.

Figure 3:
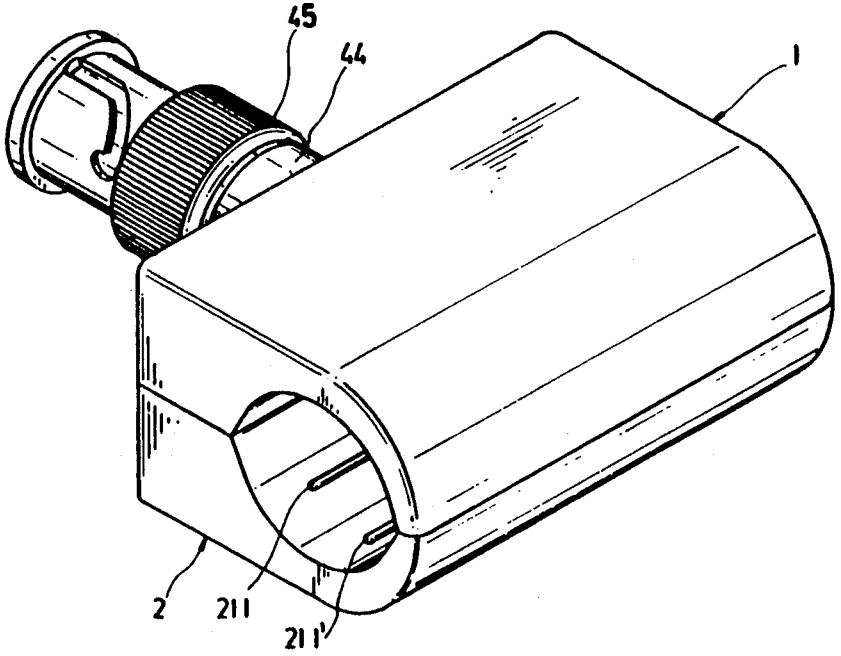
FIG. 3 is a perspective assembly view of the preferred embodiment of the T-type coaxial cable adapter of the present invention.

The aforesaid parts can be conveniently assembled into a T-type coaxial cable adapter. The upper cover 1 is attached to the bottom cover 2 by inserting the circular stub rods 232 and 232' in the round holes 132 and 231' permitting the through-holes 231 and 231' on the bottom cover 2 to be respectively vertically aligned with the bolt holes 131 and 131' on the upper cover 1. Then, fasten two screws 24 and 24' through the through-holes 231 and 231' into the bolt holes 131 and 131' to firmly secure the upper and bottom covers 1 and 2 together. After the upper and bottom covers 1 and 2 are connected together, the semi-circular grooves 11 and 21 and the semi-circular bolt holes 12 and 22 are respectively matched with each other forming into an elongated, circular hole and a bolt hole. Thus, the outer thread 41 of the BNC casing 4 can be fastened in the bolt hole which is formed by the semi-circular bolt holes 12 and 22 (see FIG. 3).

Figure 4:
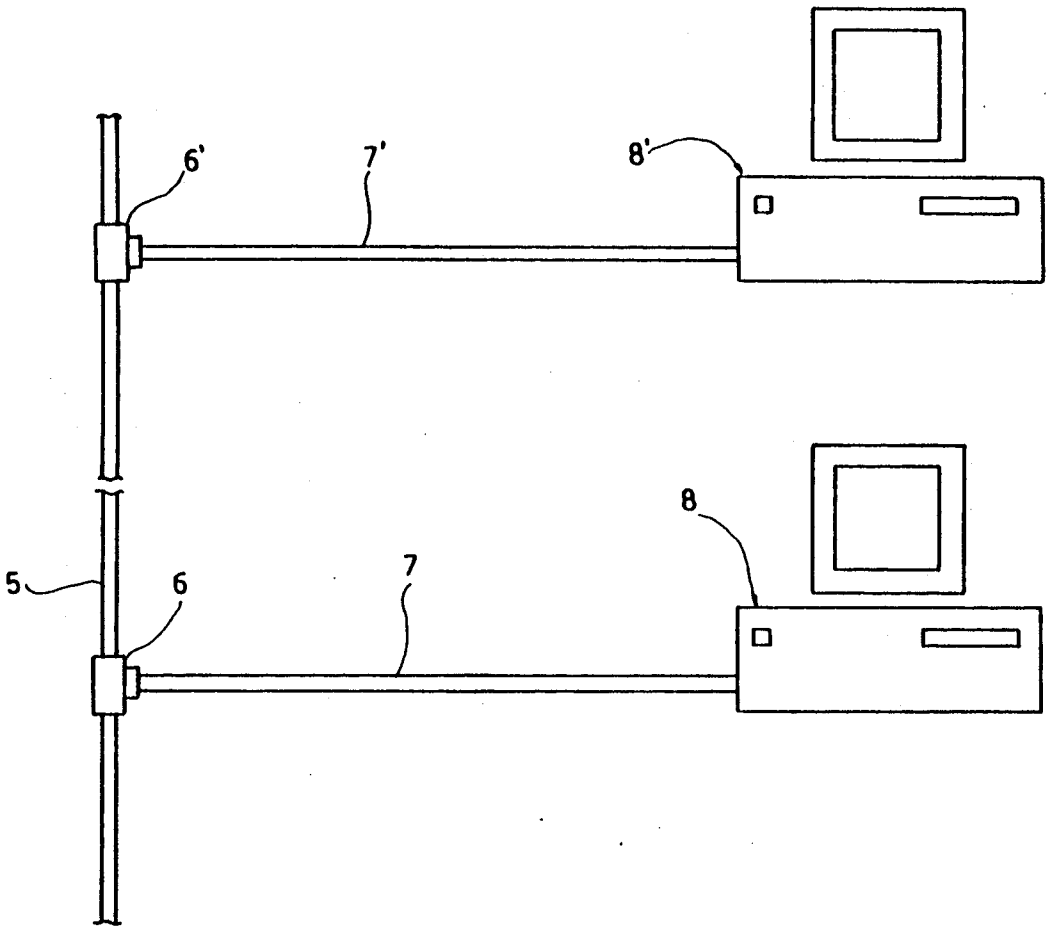
FIG. 4 illustrates an application of the present invention in which two terminals are respectively connected to a main coaxial cable by two T-type coaxial cable connectors.
Figure 5:
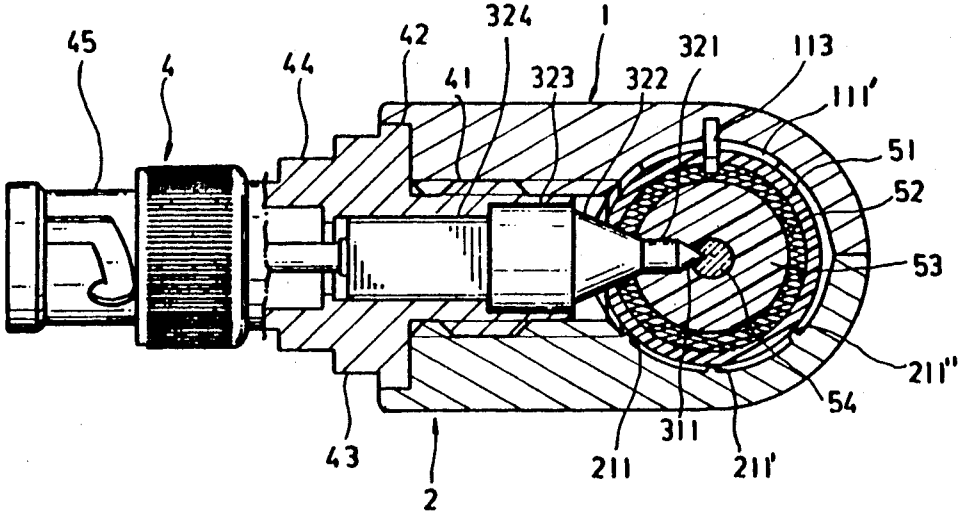
FIG. 5 is a sectional view showing that a main coaxial cable is fastened in between the upper and bottom covers to electrically connect the metal core and the BNC connector of the BNC casing.

Referring to FIG. 4, two branch coaxial cables 7 and 7' from two terminals 8 and 8' are respectively connected to a main coaxial cable 5 in a computer network system by two T-type coaxial cable connectors 6 and 6'. Installation of the present invention is easy and outlined hereinafter with reference to FIG. 5:

1. Turn the screws 24 and 24' out of the bolt holes 131 and 131' permitting the upper cover 1 and the BNC casing 4 with the terminal 3 to be respectively separated from the bottom cover 2 and then, attach the bottom cover 2 to the main coaxial cable 5 permitting the main coaxial cable 5 to be received in the elongated, semi-circular groove 21;

2. Attach the upper cover 1 to the bottom cover 2 and fasten the screws 24 and 24' in the bolt holes 131 and 131' tightly, causing the cutters 113 and 113' to respectively cut in the jacket 51 and become electrically in contact with the braid shield 52, and therefore, the upper and bottom covers 1 and 2 are both in a ground mode and have zero potential;

3. Insert a drill through the bolt hole, which is formed by the semi-circular bolt holes 12 and 22, to pierce through the jacket 51, the braid shield 52 and the inner insulator 53 of the main coaxial cable 5 permitting the conductor 54 of the main coaxial cable 5 to expose to the outside;

4. Screw up the outer thread 41 with the semi-circular bolt holes 12 and 22 permitting the projecting ring 42 to be firmly stopped at the stop edges 122 and 222 and permitting the arrow-headed portion 311 of the metal core 31 of the terminal 3 to electrically contact the conductor 54 of the main coaxial cable 5, and therefore, the conductor 54 of the main coaxial cable 5 becomes electrically connected to the metal core 31 and, the braid shield 52 of the main coaxial cable 5 becomes electrically connected to the BNC connector 45 (because the metal core 31 is covered with the outer insulator 32, not short circuit will happen between the metal core 31 and the braid shield 52 of the main coaxial cable 5); and 5. Attach the branch coaxial cable 7 or 7' to the BNC connector 45 by a BNC receptacle.

After installation, a protective covering or shield means may be attached to the T-type coaxial cable adapter to protect it against dust and moisture.

The present invention has been described in detail in connection with the preferred embodiment, but it is for example only and this invention is not restricted thereto. It will be easily understood by those skilled in the art that variations and modifications can be easily made without departing from the scope of the present invention.

I claim:

1. T-type coaxial cable adapter, comprising:

an upper made of metal material in an elongated shape having a first elongated, semi-circular groove disposed in longitudinal direction, a first semi-circular bolt hole disposed in transverse direction and connected to said first elongated, semi-circular groove at the middle, a first pair of raised top edges at two opposite sides relative to said first semi-circular bolt hole, said first pair of raised top edges having each a bolt hole and a round hole, said first elongated semi-circular groove having at least one cutter means fastened thereon;

a bottom cover made of metal material in an elongated shape having a second elongated, semi-circular groove disposed in longitudinal direction, a second semi-circular bolt hole disposed in transverse direction and connected to said second elongated, semi-circular groove at the middle, a second pair of raised top edges at two opposite sides relative to said second semi-circular bolt hole, said second pair of raised top edges having each a through-hole and a stub rod corresponding to said bolt hole and stub rod on either of said first pair of raised top edges;

a BNC casing being a hollow metal shell having made around the outer wall surface thereof in proper order an outer thread, a projecting ring, a polygonal projection and a flange and, having fastened therein a BNC connector at one end opposite to said outer thread;

a terminal fastened in said BNC casing, comprising an elongated metal core covered with an outer insulator, said metal core having an arrow-headed front end extending out of said outer insulator and said BNC casing and a rear end extending out of said outer insulator and disposed inside said BNC connector; and wherein two screws respectively fastened through the through-holes on said second pair of raised top edges in the bolt holes on said first pair of raised top edges to firmly secure said upper cover to said bottom cover, permitting said first and second semi-circular bolt holes to incorporate with each other into a bolt hole for fastening the outer thread on said BNC casing and, permitting said first and second elongated, semi-circular holes to incorporate with each other into a through-hole for mounting an coaxial cable having a conductor and a braid shield insulated from said conductor and covered with an insulative jacket, so as to let the conductor of said coaxial cable to be electrically connected to said metal core and the braid shield of said coaxial cable to be electrically connected to said BNC connector via said cutter means.

2. The T-type coaxial cable adapter of claim 1, wherein said first and second semi-circular grooves have each a plurality of ribs raising from the upper surface thereof.

3. The T-type coaxial cable adapter of claim 1, wherein said first pair of raised top edges have each a round hole made thereon and said second pair of raised top edges have each a stub rod made thereon and respectively fastened in said round hole.

4. The T-type coaxial cable adapter of claim 1, wherein said first and second semi-circular bolt holes have each a semi-circular recess longitudinally aligned, said semi-circular recess having an inner diameter wider than said first and second semi-circular bolt holes to bear said projecting ring when said BNC casing is fastened in between said upper and bottom covers with its outer thread screwed up with said first and second semi-circular bolt holes.

* * * * *